US009662618B2

(12) United States Patent
Snodgrass et al.

(10) Patent No.: US 9,662,618 B2
(45) Date of Patent: May 30, 2017

(54) SOLID PRODUCT DISPENSER

(71) Applicant: Ecolab USA Inc., St. Paul, MN (US)

(72) Inventors: Edward J. Snodgrass, Iner Grove Heights, MN (US); Matthew P. Molinaro, Eagan, MN (US); Brian Philip Carlson, Lakeville, MN (US)

(73) Assignee: Ecolab USA Inc., St. Paul, MN (US)

( * ) Notice: Subject to any disclaimer, the term of this patent is extended or adjusted under 35 U.S.C. 154(b) by 434 days.

(21) Appl. No.: 14/143,667

(22) Filed: Dec. 30, 2013

(65) Prior Publication Data

US 2014/0263404 A1 Sep. 18, 2014

Related U.S. Application Data

(63) Continuation-in-part of application No. 13/827,569, filed on Mar. 14, 2013.

(51) Int. Cl.
*B01F 1/00* (2006.01)

(52) U.S. Cl.
CPC ..... *B01F 1/0027* (2013.01)

(58) Field of Classification Search
CPC ..... B01F 1/0027
See application file for complete search history.

(56) References Cited

U.S. PATENT DOCUMENTS 989,826 A * 4/1911 Thiele ..... B01F 1/0027 126/284
2,477,998 A 8/1949 McCowan
2,624,619 A 1/1953 Fletcher et al.
2,936,898 A * 5/1960 Miguez ..... A47L 19/04 211/41.3
4,420,394 A 12/1983 Lewis
4,438,534 A 3/1984 Keyes et al.
4,777,670 A 10/1988 Klinkhammer et al.
(Continued)

FOREIGN PATENT DOCUMENTS

EP 0413373 B1 3/1993
EP 2125250 B1 11/2011
(Continued)

OTHER PUBLICATIONS

International Search Report and Written Opinion for International Application No. PCT/US2014/066818, mailed Feb. 27, 2015, 14 pages.

(Continued)

*Primary Examiner* — Sean E Conley
*Assistant Examiner* — Donald Spamer
(74) *Attorney, Agent, or Firm* — Fredrikson & Byron, P.A.

(57) ABSTRACT

A method and apparatus for dispensing a solution of a solid product in a fluid. A freestanding apparatus comprises an inlet portion through which fluid enters, a reaction portion in which the fluid encounters and dissolves the product to form a solution, and an outlet portion from which the solution exits the apparatus. Fluid may encounter the product from a single direction or multiple directions, and from the top or the bottom. The apparatus can include a fluid diverter for directing fluid to the desired portion of the solid product. The apparatus may be configured to receive a particularly shaped solid product, and may comprise a lid or gate to prevent fluid from contacting the product undesirably.

26 Claims, 15 Drawing Sheets

(56) References Cited

U.S. PATENT DOCUMENTS

| | | | | |
|---|---|---|---|---|
| 4,898,202 | A | 2/1990 | Craig | |
| 4,957,134 | A | 9/1990 | Craig | |
| 5,007,559 | A | 4/1991 | Young | |
| 5,262,132 | A | 11/1993 | Bricker et al. | |
| 5,379,813 | A | 1/1995 | Ing | |
| 5,389,344 | A | 2/1995 | Copeland et al. | |
| 5,441,711 | A | 8/1995 | Drewery et al. | |
| 5,580,448 | A | 12/1996 | Brandreth | |
| 5,932,093 | A | 8/1999 | Chulick | |
| 6,164,042 | A | 12/2000 | Tobolka | |
| 6,247,189 | B1 | 6/2001 | Dean et al. | |
| 6,267,886 | B1 | 7/2001 | Brandreth, III | |
| 6,287,466 | B1 | 9/2001 | Yassin | |
| 6,662,380 | B1 * | 12/2003 | Leonard | E03D 9/032 4/231 |
| 6,773,668 | B1 | 8/2004 | Everson et al. | |
| 7,069,602 | B1 | 7/2006 | Conway et al. | |
| 7,143,898 | B1 * | 12/2006 | Hoaglin | B01D 29/035 210/445 |
| 7,250,086 | B2 | 7/2007 | Furber et al. | |
| 7,934,403 | B2 | 5/2011 | Cho et al. | |
| 8,230,777 | B2 | 7/2012 | Anson et al. | |
| 2003/0205286 | A1 | 11/2003 | Hennemann et al. | |
| 2005/0121058 | A1 | 6/2005 | Furber et al. | |
| 2006/0133070 | A1 * | 6/2006 | Brown | F21V 21/0885 362/106 |
| 2006/0191833 | A1 * | 8/2006 | Greene | C02F 1/688 210/206 |
| 2007/0214555 | A1 | 9/2007 | Ferrara et al. | |
| 2010/0059421 | A1 | 3/2010 | Reed et al. | |
| 2010/0239476 | A1 | 9/2010 | King et al. | |
| 2012/0001776 | A1 | 1/2012 | Yu et al. | |
| 2012/0152813 | A1 | 6/2012 | Stafford | |

FOREIGN PATENT DOCUMENTS

| | | | |
|---|---|---|---|
| FR | 2764821 | B1 | 8/1999 |
| JP | H03084130 | A | 4/1991 |

OTHER PUBLICATIONS

"Polypropylene". Wikipedia. Screen capture from Feb. 29, 2012. 7 pages.

International Search Report and Written Opinion for International Application No. PCT/US2014/019978, mailed Jul. 8, 2014, 16 pages.

Partial Machine Translation of Publication FR2764821, Aug. 27, 1999, 6 pages.

European Patent Application No. 14776122.5, Extended European Search Report mailed Oct. 18, 2016, 8 pages.

* cited by examiner

SOLID PRODUCT DISPENSER

PRIORITY CLAIM

The present application claims priority to and is a continuation-in-part of U.S. patent application Ser. No. 13/827,569, filed Mar. 14, 2013, and entitled "Method for Dispensing Solid Products," and which is incorporated entirely herein by reference.

BACKGROUND

Solutions formed from dissolving a solid product in a fluid have been long known and utilized for many applications. Accordingly, solution-forming devices have been developed in order to create desired solutions without the need to manually create them. Instead, a fluid is supplied to the device, the solution is formed therein and then flows out the device. Such devices may be used to create cleaning and sanitizing solutions or other desired solutions.

Many of such solution-forming devices have been in-line systems, in which the device is fixedly connected to the fluid supply. In such a device, fluid will travel through the device whether a solution is desired or not. To prevent unwanted solution formation, either the product must be removed from the device to eliminate the chance of mixing, or alternative routing of the fluid is necessary. Continually removing and replacing the a solid product into the device could be a tedious and annoying task to a user, and rerouting fluid flow may be a costly and/or inconvenient modification to a system.

Additionally, in the case of a potable water supply, it may be necessary to prevent solutions from flowing back into the water supply, as the solutions may be hazardous for consumption. As such, many previous solution-forming devices require some sort of backflow prevention device to prevent the formed solution from flowing back through the device and into the water supply. Such backflow prevention devices, however, add cost and complexity to the design of the solution-forming device.

SUMMARY

Embodiments of the present invention relate to methods and dispensers for dissolving a solid product in a fluid to create a solution and dispensing the solution. Dispensers are generally freestanding and can comprise a fluid diverter to which fluid can be applied. The dispenser can include a product guide for receiving the solid product. In some embodiments, the product guide can surround a height of the solid product, for example when the product is disposed vertically in the product guide. The product guide can comprise a wall for enclosing a portion of the solid product. The fluid diverter can direct incident fluid to a reaction portion, where it encounters at least a portion of the solid product. In the reaction portion, the fluid dissolves the product and forms a solution. The solution then exits the apparatus through an outlet portion, for example, and output drain.

In some embodiments, the fluid diverter is disposed above the solid product and is coupled to the product guide. The fluid diverter can be configured to divert an input fluid around the exterior of the product guide toward the base of the solid product. The dispenser can include a vertical channel disposed between an outer wall of the dispenser and the product guide through which the fluid can be diverted. In some embodiments, the vertical channel can extend around substantially the entire outer surface of the wall of the product guide. In further embodiments, the fluid diverter can be configured to disperse fluid completely or nearly completely around the perimeter of the fluid diverter. In such embodiments, fluid can be directed through the vertical channel and contact the base of the solid product on all sides. Fluid can flow inward from the vertical channel, dissolve the product to create a solution, and exit the dispenser through a center output drain.

In other embodiments, the diverter can be configured to direct fluid to a fill chamber disposed beneath the solid product. In these embodiments, fluid floods the fill chamber and flows up into the reaction portion via an aperture in the base of the reaction portion. Fluid contacts and dissolves the base of the solid product to form a solution, which floods the reaction portion, which can be surrounded by a wall. Once the solution fills the reaction portion to the top of the wall, it spills over into an annular output channel and flows to an output drain.

The fluid diverter can alternatively be configured to direct fluid to the top surface of the solid product. For example, the diverter can be configured to spread incident fluid to a series of apertures in the diverter such that fluid can flow through the apertures and encounter the top surface of the solid product. Apertures can be shaped, sized, and positioned to accommodate desired flow patterns.

Certain embodiments of the dispenser can include a cover for preventing fluid from being directed undesirably toward the solid product. In some embodiments, the cover can be annularly shaped so as to substantially cover a vertical channel surrounding the product guide so that fluid is not applied directly to the vertical channel but is first applied to the fluid diverter. The cover can include a grate disposed over the fluid diverter. The grate can be such that fluid can be applied to the fluid diverter through the grate, but the grate prevents fluid from splashing out of the dispenser from the fluid diverter.

The dispenser can include a handle for securing the dispenser to a supporting element. The handle can be spring-loaded so as to apply a squeezing force on a supporting element between the handle and a portion of the dispenser body such as an outer wall. The dispenser can comprise a tab formed in an outer wall and proximate the handle. In some embodiments, the dispenser can comprise a notch between the outer wall and the tab meant for receiving a lip or edge of a supporting element. The tab and/or handle can include high friction surfaces for engaging a portion of the supporting element to increase the coefficient of friction between engaging portions of the dispenser and the supporting element. Notch and/or high friction surfaces can act to provide stability to the dispenser when supported by a supporting element.

Various embodiments of the invention can lead to varying properties of the dispensed solution. Different configurations result in fluid impacting the solid product with different energies and flow patterns. Embodiments to be used for a particular application can be selected based on the desired properties such as a high concentration or a consistent concentration over time. Methods of and apparatuses for dispensing a solid product fall within the scope of the present invention. The details of one or more examples and embodiments of the invention are set forth in the accompanying drawings and the description below. Other features, objects, and advantages will be apparent from the description and the drawings, as well as from the claims of the invention.

DETAILED DESCRIPTION

The present invention is aimed at creating an easy-to-use, cost-effective, and repeatable means for creating solutions of appropriate concentrations. Embodiments of the invention are designed to dispense a solution formed from a solid product and an incident fluid such as water. The solid product may comprise many different products, including but not limited to a sanitizer, a detergent, or a floor care product, as many applications of the present invention may involve creating a solution for a cleaning process. In many cases, it is desirable to achieve and maintain a certain concentration of a solution for cost, performance, or even regulatory reasons.

Figure 1A:
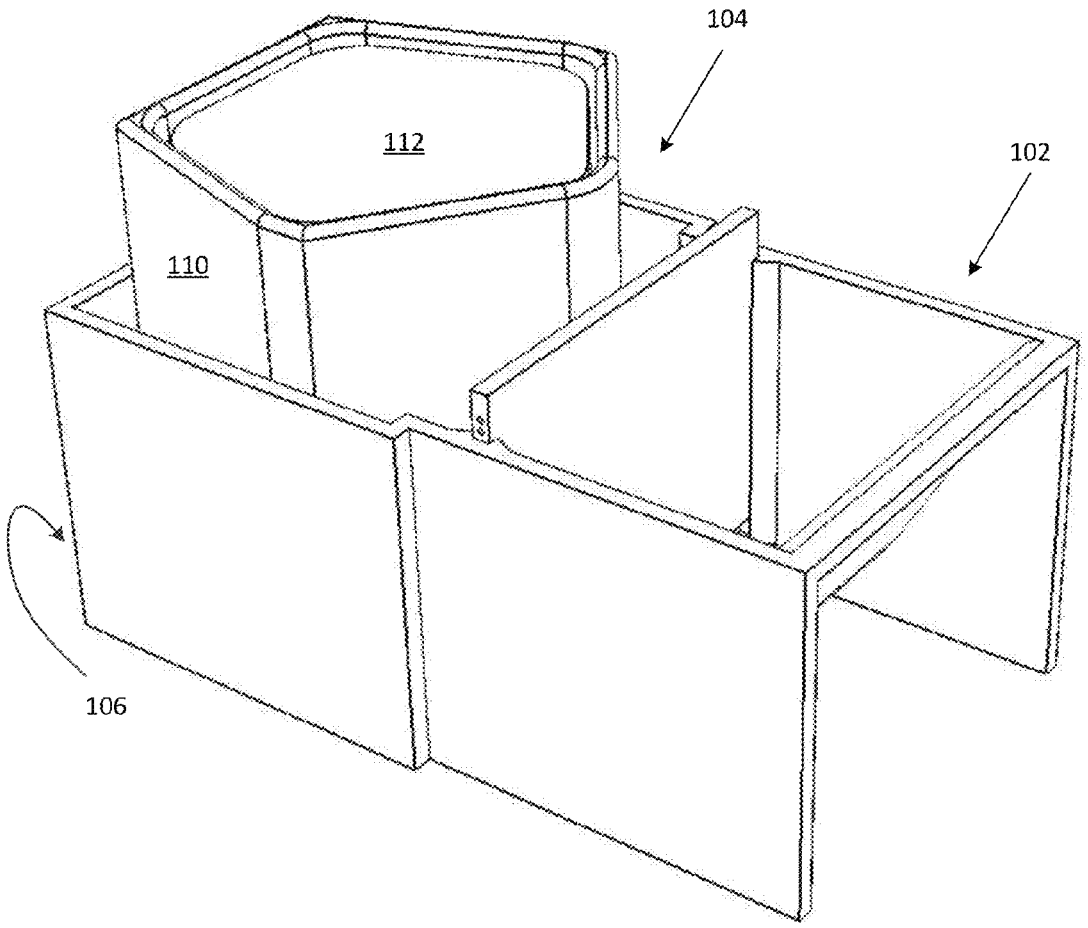
FIG. 1A shows a perspective view of an embodiment of the invention.

FIG. 1A shows a perspective view of an embodiment of the invention. This embodiment of a solid product dispenser 100 comprises an inlet portion 102, which receives an incident fluid, a reaction portion 104, in which the fluid encounters the solid product, and an outlet portion 106, from which the solution of the two is dispensed. The reaction portion comprises a solid product 112 intended for dissolving in a fluid to create a solution. Fluid is introduced into this embodiment by being supplied to the inlet portion 102. From there, it flows into the reaction portion, where it comes into contact with the solid product. Fluid dissolves contacting portions of the solid product 112, which then dissolves into the fluid, thereby creating a solution. This solution continues through the reaction portion to the outlet portion, where it is dispensed from the invention. The embodiment of the invention shown in FIG. 1A further comprises a product guide 110, which is housed at least partially within the reaction portion and is configured to hold the solid product. Particular embodiments of the invention may be designed to hold a particular product, which may be shaped in a particular defining way. Thus, the product guide of various embodiments may be uniquely shaped so as to receive a particular solid product.

While the product 112 and product guide 110 of FIG. 1A are shown as pentagonal, they could just as well by any other shape, such as triangular, hexagonal, or rectangular. In some embodiments of the invention, the shape of the solid product is indicative of the solid product itself. For example, a pentagonal product may comprise a detergent, a hexagonal product may comprise a sanitizer, and a square product may comprise a floor care product. Accordingly, different embodiments of the invention may be used for different desired applications, as the shape of the product guide may indicate the desired product of use. Additional embodiments of the invention may comprise a product lockout, which may prevent a product of an incorrect shape, and therefore incorrect composition, from being used. Embodiments of the present invention may comprise various materials, for example metals, plastics, composite, etc. Further embodiments may comprise polypropylene.

Figure 1B:
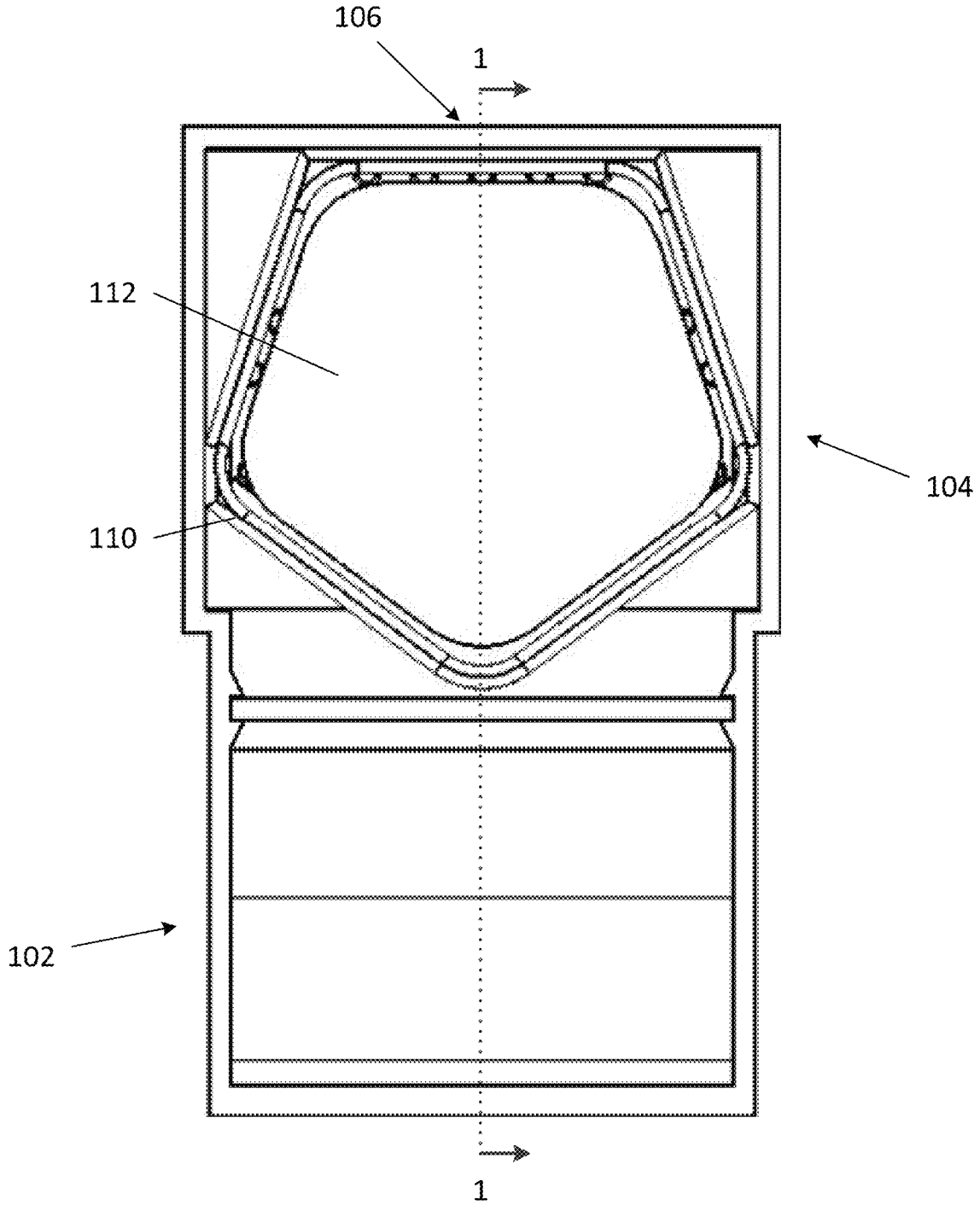
FIG. 1B shows a top-down view of an embodiment of the invention similar to the one illustrated in FIG. 1A.
Figure 1C:
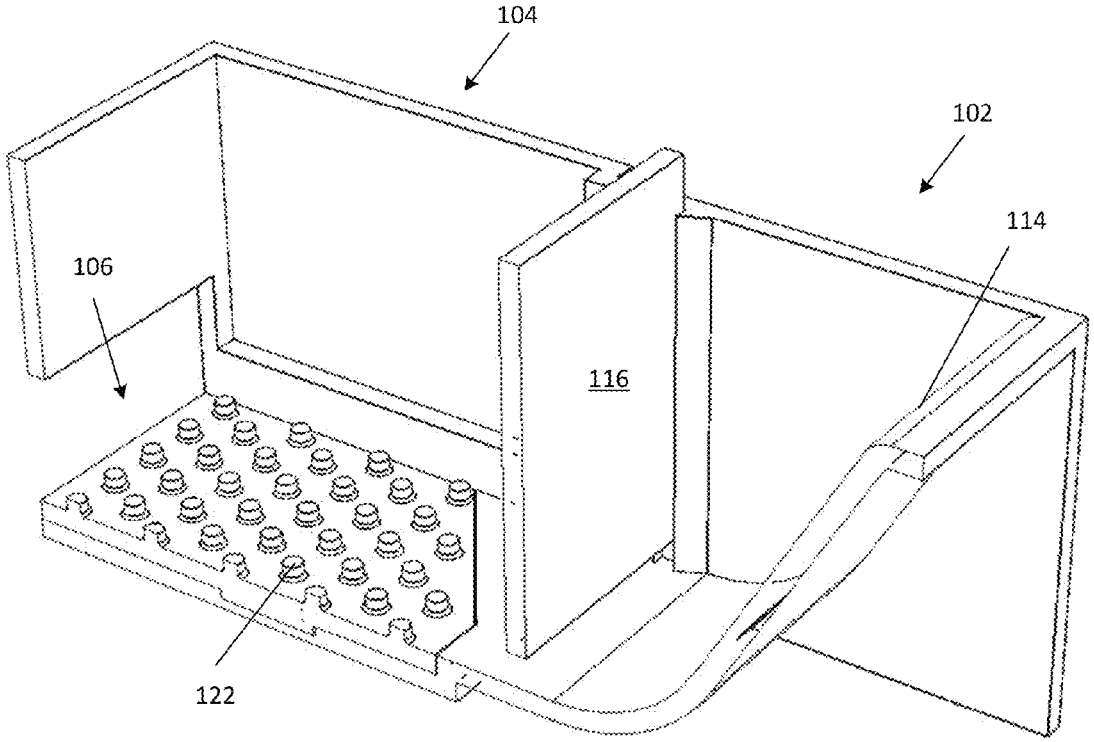
FIG. 1C shows a cross-sectional view of the embodiment of FIG. 1B, taken at line 1-1 in FIG. 1B.

FIG. 1B shows a top-down view of an embodiment of the invention similar to the one illustrated in FIG. 1A. Shown is the inlet portion 102, the reaction portion 104, and the outlet portion 106, as well as the product guide 110 and solid product 112. FIG. 1C shows a cross-sectional view of the embodiment of FIG. 1B, taken at line 1-1 in FIG. 1B. As shown, this embodiment further comprises a lead-in ramp 114 as part of the inlet portion 102, such that fluid incident to the inlet portion 102 impinges on the lead-in ramp 114. Fluid then flows down the lead-in ramp 114 into the reaction portion 104. The lead-in ramp 114 may provide a surface oriented at an angle to the fluid incident to the inlet portion 102. In this case, the angular relationship may minimize undesired splashing of the fluid either out of the dispenser or onto the solid product 112. Additionally, the lead-in ramp may comprise a textured surface to encourage the incident fluid to spread out as it travels towards the reaction portion. Some embodiments may also comprise a gate 116 in order to at least prevent undesired splashing of incident fluid onto the surface of the product 112. In some embodiments, the gate may additionally provide the boundary between the inlet portion and the reaction portion. In still further embodiments, the gate may additionally regulate the rate of flow of the fluid between the inlet portion and the reaction portion, and may be adjusted in height to change the rate of flow.

In certain embodiments of the invention, the dispenser may comprise pegs 122, shown in FIG. 1C as being located on the bottom surface of the dispenser, intended to support the solid product 112 above the floor of the reaction portion 104 as fluid flows through the spaces therebetween. Ideally, in operation, the pegs 122 are shorter than the depth of the fluid so that the fluid will contact at least a portion of the solid product 112 as it flows through the pegs 122. Taller pegs 122 will support the product 112 further above the base of the dispenser than will shorter pegs 122, thereby supporting the product 112 further out of the fluid and changing the amount of surface contact therebetween. Peg heights may be optimized in a laboratory or factory prior to implementation into the dispenser so that a desired amount of interaction between the solid product 112 and the fluid may occur depending on a either a specific incident fluid flow rate or a particular range thereof. Adjustable or interchangeable pegs are also contemplated, allowing the end user to change the height of the pegs 122. Pegs 122 may also be affixed to a peg plate, which may itself be entirely replaceable by the user.

The number or area density of pegs may vary from embodiment to embodiment; however it will be appreciated that a lower number of pegs will result in more mass of the solid product per surface area of pegs, potentially creating a risk for the solid product 112 to sink down onto the pegs 122 and embedding them therein. Too many pegs 122, however, may inhibit the ability for fluid to flow through the dispenser. After flowing through the pegs 122 and contacting the solid product 112, fluid may exit the dispenser through the outlet portion 106 via an opening to the outside of the dispenser.

Figure 2:
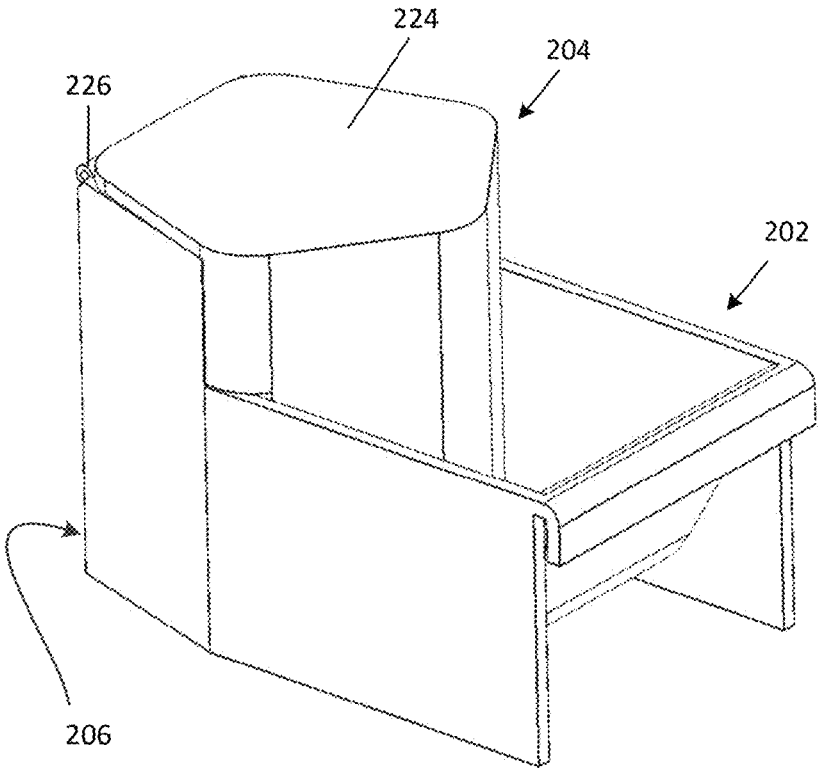
FIGS. 2 and 3 show alternative embodiments of the invention.
Figure 3:
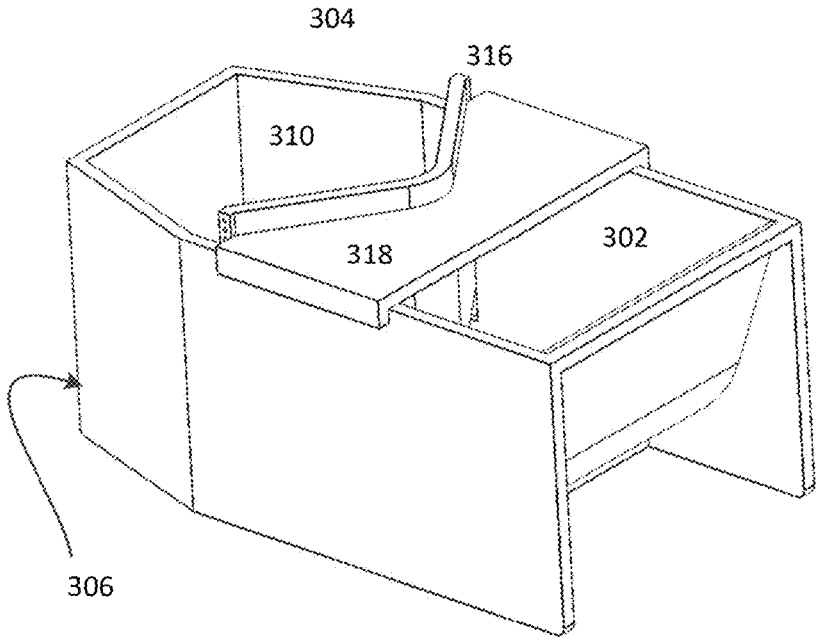

FIGS. 2 and 3 show alternative embodiments of the invention. The dispenser of FIG. 2 further comprises a closable lid 224 which, when closed, covers the solid product within the reaction portion 204. In some embodiments, the lid covers the top and the side of the solid product facing the inlet portion 202, shielding it from undesired exposure to the incident fluid such as splashing from the inlet portion 202 or incorrect operation of the dispenser. The lid 224 may be attached to the dispenser by attachment means, such as a hinge 226 or other method of attachment known in the art, or it may be entirely removable from the dispenser. FIG. 3 shows an embodiment of the invention with no lid, but further comprising a splash guard 318. Splash guard 318 acts in conjunction with gate 316 to prevent undesired fluid from coming into contact with the solid product by blocking fluid that may otherwise splash up and over the gate The concentration of the solid product in the solution formed is dependent upon several factors. Fluid temperature and flow rate, as well as the amount of solid product contacting the fluid and any specific chemistry therebetween, may affect the concentration of the solution. Desired concentrations may vary from application to application, however it is advantageous to be able to both achieve and maintain a desired concentration. Thus, in some embodiments, it is preferred that the solid product be dissolved uniformly across the bottom surface by the fluid. This may be advantageous since otherwise, non-uniform dissolution may cause surface deformations on the solid product, resulting in a change of surface area exposed to the incident fluid. This may then result in undesired changes in the concentration of the solid product in the solution.

Figure 4A:
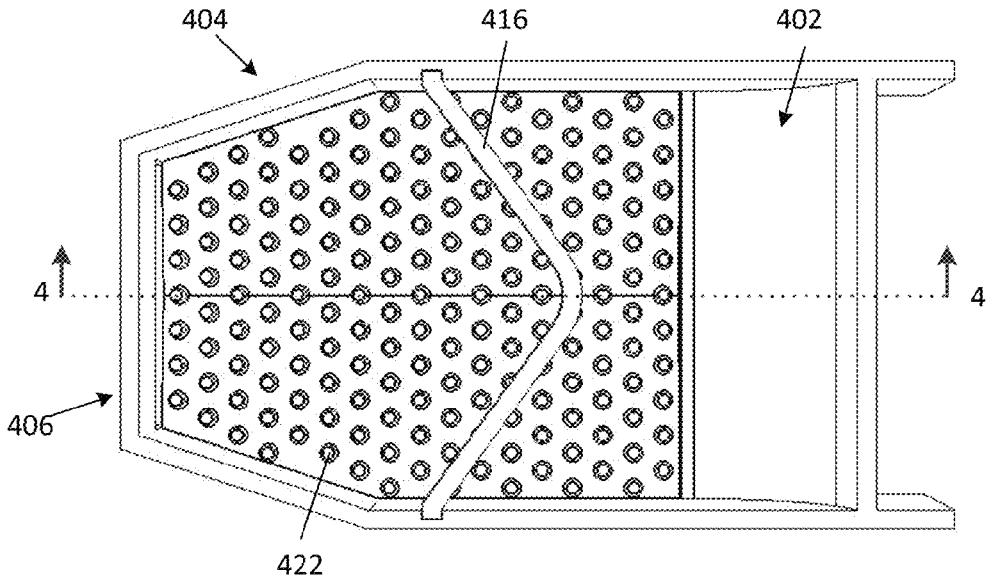
FIG. 4A shows a top view of an embodiment of the invention.
Figure 4B:
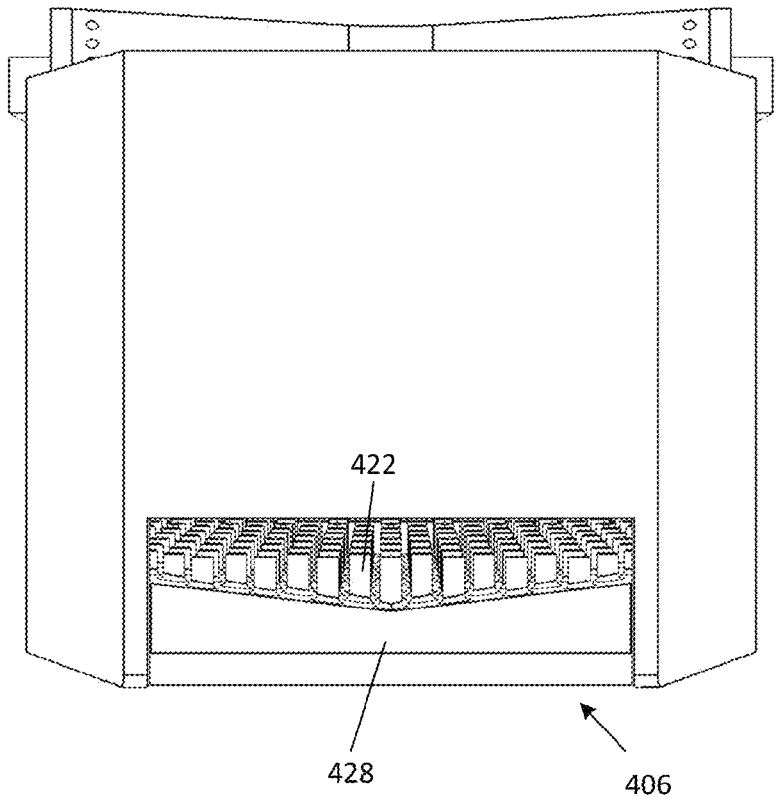
FIG. 4B shows an elevational view of an embodiment of the invention.

FIGS. 4A and 4B show embodiments of the invention comprising components aimed to create and/or maintain uniform dissolution of the solid product substantially across a single surface. FIG. 4A shows a top view of an embodiment of the invention. As was the case with the embodiment illustrated in FIG. 1C, the embodiment of FIG. 4A comprises pegs 422 on the bottom surface of the dispenser, however these pegs 422 can be seen to extend beyond the perimeter of the gate 416, which encloses the solid product, towards the inlet portion, providing pegs in the dispenser not supporting the solid product, but rather "upstream" from the product. As fluid enters the dispenser via the inlet portion and is initially incident on the front surface of the pegs 422, turbulence may be created, resulting in upward displacement of the incident fluid. Were the solid product 412 to be situated on these pegs, the upwardly displaced fluid may come into contact with the product and cause non-uniform and/or undesired erosion. Thus, in this embodiment, the pegs 422 extend outside of the area where the solid product is to be held so that this initial contact with the pegs, and its induced turbulence and potential upward displacement of fluid, may occur prior to the fluid reaching the product, by which time the fluid may reach a steady state flow pattern. In this embodiment, three rows of pegs 422 are located between the inlet portion and the nearest point of the gate.

In other situations, fluid dynamics within the dispenser may cause width-wise non-uniform flow rates across the reaction portion. In some instances, for example, the product erodes more quickly near the edges of the dispenser as compared to in the center, suggesting perhaps faster, preferred fluid flow around the edges. FIG. 4B shows an elevational view of an embodiment of the invention intended to help fix such non-uniformity. Shown is the outlet portion 406 of the dispenser from where the solution is dispensed. Through the outlet portion 406, the pegs 422 are visible, as is the base of the reaction portion of the dispenser, referred here to as the hull 428; however the hull need not be limited to the base of the reaction portion. In this embodiment, the hull 428 comprises a V-shaped hull 428*a*, as its cross-section resembles that of the letter "V". The V-shaped hull 428*a* acts to draw more fluid from the edges of the dispenser towards the middle while fluid is flowing through the reaction portion. This reduces the enhanced erosion nearer the edges described previously, resulting in a more uniform dissolution process across the bottom surface of the solid product and a greater likelihood of maintaining a desired concentration during operation. It will be appreciated by one skilled in the art that the 'V' shape of the hull shown herein is not the only shape that may be used to accomplish such a process. Other hull shapes are contemplated such as a "U" shape, a parabolic shape, or any other shape that may divert some of the fluid flow away from the edges and towards the central pathway from the inlet to the outlet.

Figure 4C:
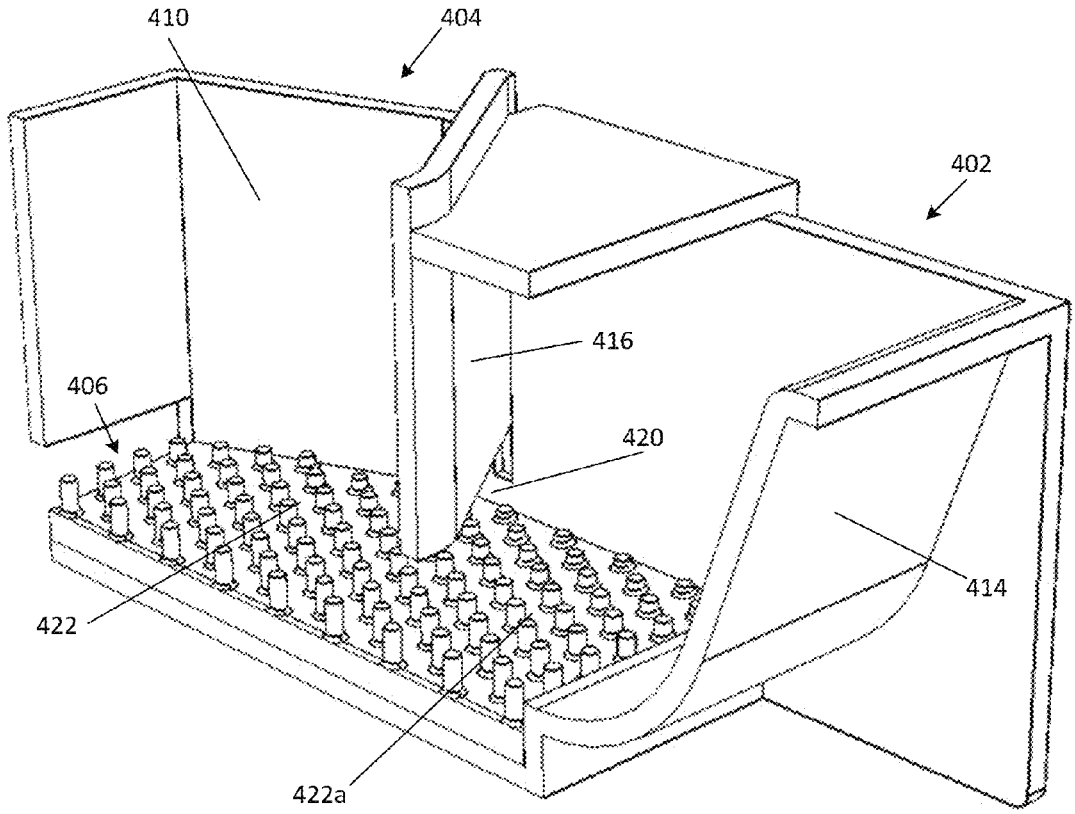
FIG. 4C is a cross-sectional perspective view an embodiment of the invention, taken at line 4-4 in FIG. 4A.

FIG. 4*c* is a cross-sectional perspective view an embodiment of the invention comprising features illustrated in FIGS. 4A and 4B, with the cross section taken at line 4-4 in FIG. 4A. In this embodiment, the fluid enters the inlet portion 402 which comprises a lead-in ramp 414. The fluid contacts and flows down the lead-in ramp 414, which directs the fluid towards pegs 422 along the bottom of the dispenser. The fluid contacts a first series of pegs 422, which may induce turbulence into the fluid. It is assumed, however, that after the fluid has passed the first series of pegs 422, much of the induced turbulence will have substantially subsided, resulting in generally steady state fluid flow beyond this point. In some embodiments, this first series of pegs comprises at least three rows of pegs in order to provide a sufficiently long flow path for the fluid flow to reach a steady state. Beyond the first series of pegs 422, fluid ideally flows in a steady-state through a gap 420 under the gate 416 and into the area surrounded by the product guide, configured for holding the solid product atop the pegs 422 therein. With a solid product in place in the product guide 410, fluid contacts the solid product and erodes it, forming a solution of the product in the fluid. The solution then flows to the outlet portion 406, where it exits the dispenser. Embodiments such as the one shown in FIG. 4*c* may additionally comprise a hull such as the aforementioned V-shaped hull 428*a* to aid in uniform dissolution of the solid product. While the reaction portion of FIG. 4*c* is designed to hold a product of a particular shape, it will be appreciated that embodiments similar to the one shown in FIG. 4*c* may be configured for receiving products of differing shapes.

While the embodiments illustrated in the figures described thus far have featured fluid flow generally in one linear direction, other embodiments of the invention may comprise other flow patterns as well. For example, fluid may enter the dispenser via an inlet portion and flow into the reaction portion in a first direction and flow out of the outlet portion in a second direction, different from the first. It will be appreciated by those skilled in the art that many configurations fall within the scope of the invention. Another such alternate configuration is described below.

Figure 5A:
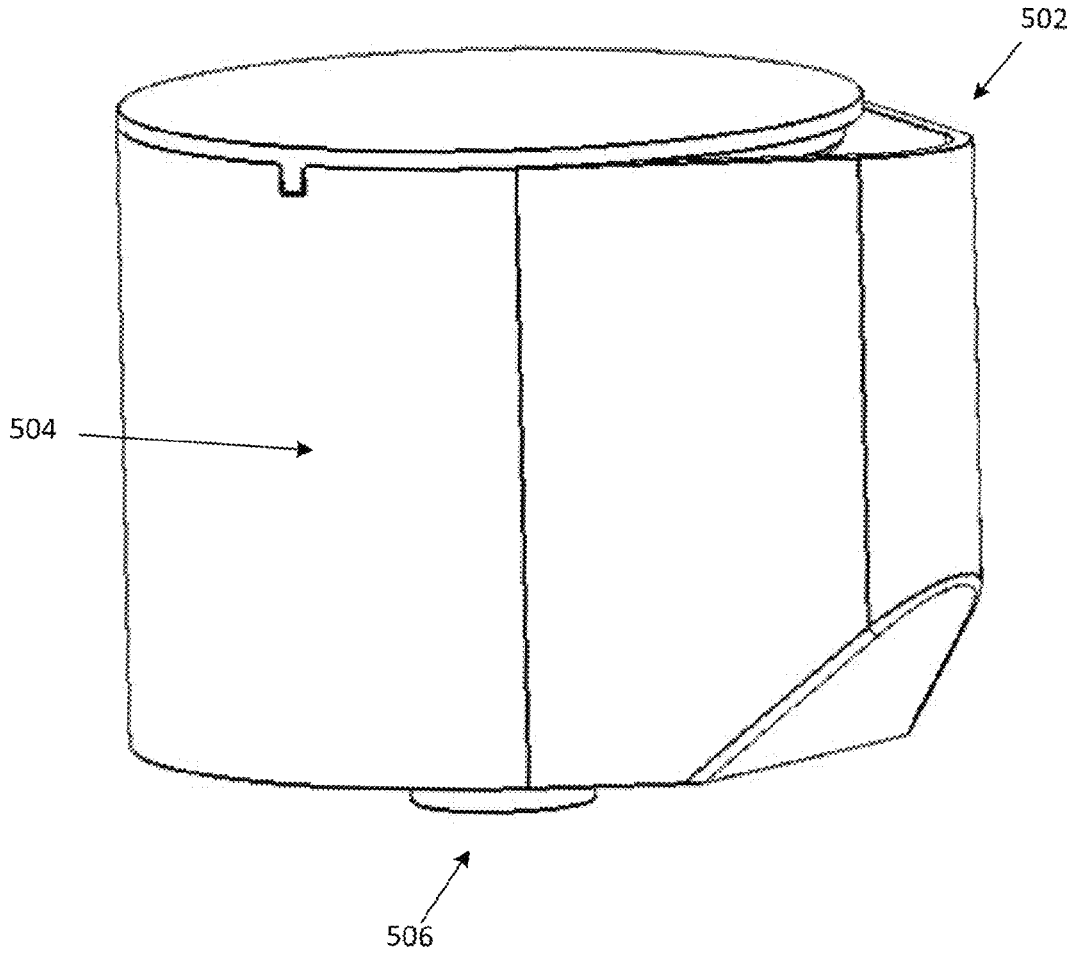
FIG. 5A is a perspective view of an alternative embodiment of the invention.
Figure 5B:
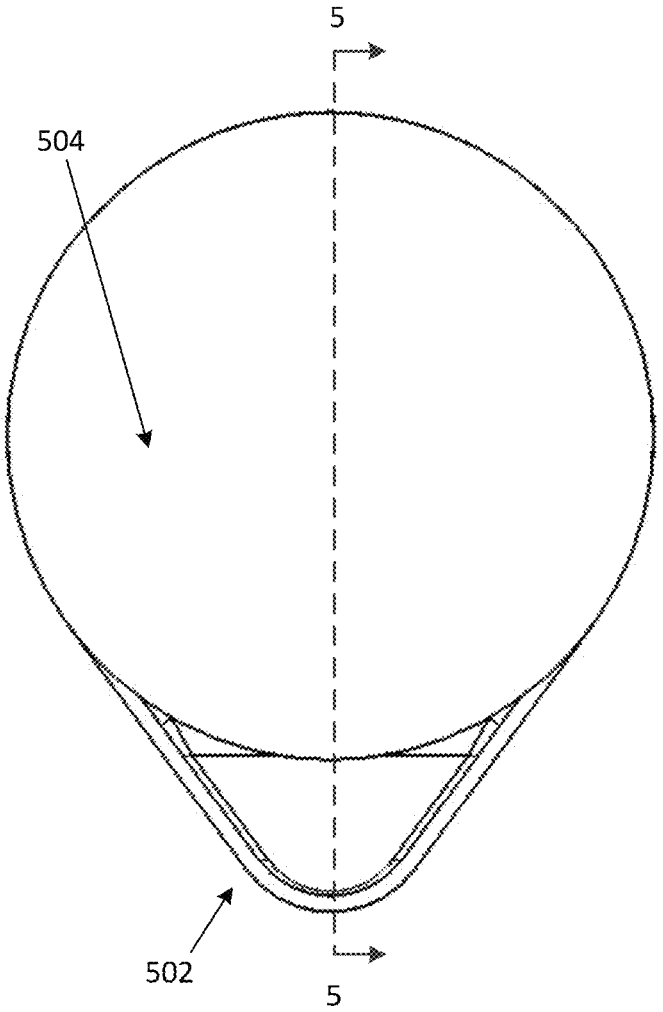
FIG. 5B is a top-down view of the embodiment of the invention of FIG. 5A.
Figure 5C:
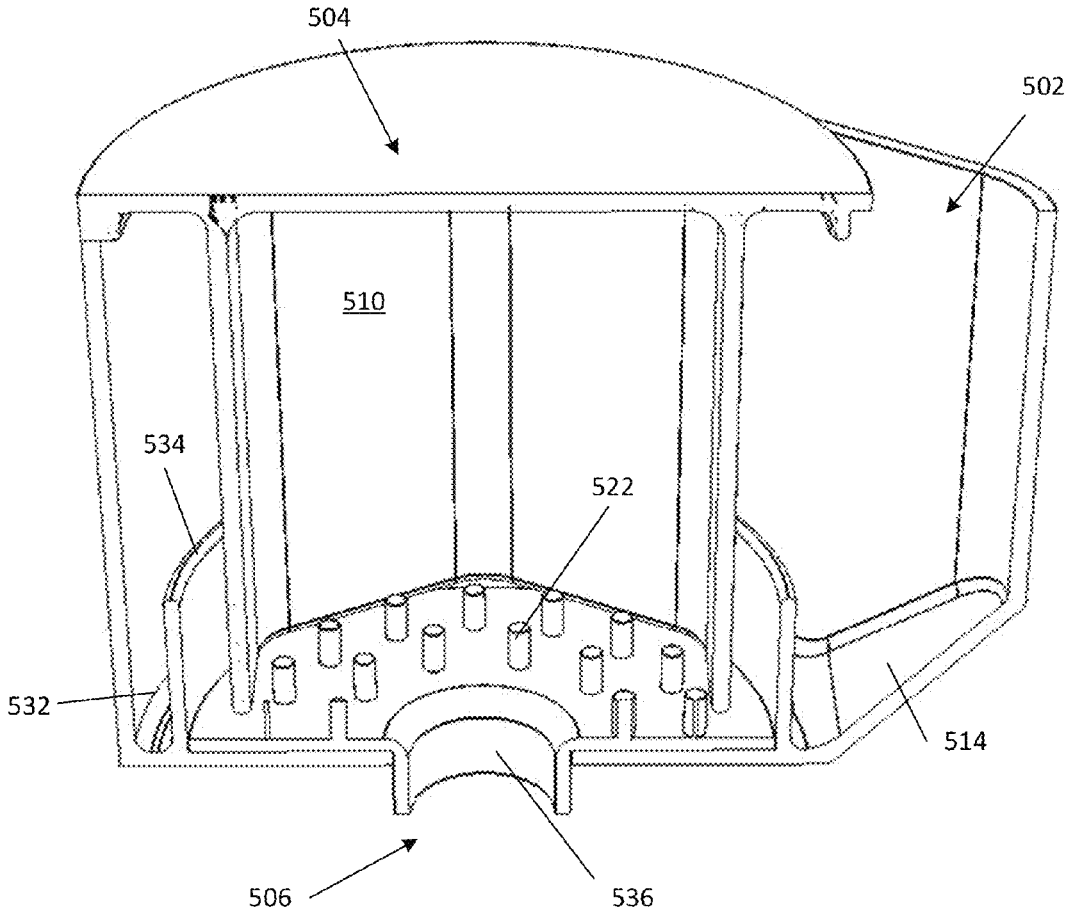
FIG. 5C is a cross-sectional view of the embodiment, taken at line 5-5 in FIG. 5B.

FIGS. 5A, 5B, and 5C illustrate yet another embodiment of the invention, comprising inlet 502, reaction 504, and outlet 506, portions. FIG. 5A is a perspective view of an embodiment of the invention, showing the inlet 502, reaction 504, and outlet 506 portions. FIG. 5B is a top-down view of the embodiment of the invention of FIG. 5A, and FIG. 5C is a cross-sectional view of the embodiment, taken at 5-5 in FIG. 5B. In this embodiment, fluid is received via inlet portion 502, where it contacts lead-in ramp 514. Fluid flows down the ramp 514 and into an annular channel 532 formed by a wall 534. With nowhere else to flow, the fluid accumulates in the annular channel 532, causing the fluid level to rise. Once the fluid level has reached the height of the wall 534, additional fluid added to the inlet portion 502 will cause fluid in the annular channel 532 to spill over the wall 534 and into the reaction portion 504 of the dispenser. Fluid flows under the confines of the product guide 510, which houses a solid product supported by an arrangement of pegs 522. Fluid flows through pegs 522 while contacting at least a portion of the solid product supported thereon. The fluid erodes the product, which then forms a solution with the fluid. Finally the solution flows out of the outlet portion 506 of the dispenser via the output drain 536. It is important that the output drain 536 be large enough to permit a sufficient flow rate out of the dispenser, lest the fluid level rise and contact more surface of the solid product 512 or flood the dispenser.

The embodiment described above allows the fluid to impinge on each side of the solid product, as the fluid will fill the annular channel uniformly and spill over and flow towards the product on all sides, provided the wall height is uniform. This is in contrast to the substantially single-dimensional flow patterns of the previous embodiments, and may contribute to a more even pattern of dissolution across the solid product. While the embodiment of FIG. 5C suggests a circular (annular) channel, other shapes may also be used. As described above, various solid products may be shaped in various defining ways, and thus, it may be that to receive a particular desired product, the channel and/or wall forming the channel may be shaped similarly to the desired product, or arranged in any other shape.

Figure 6:
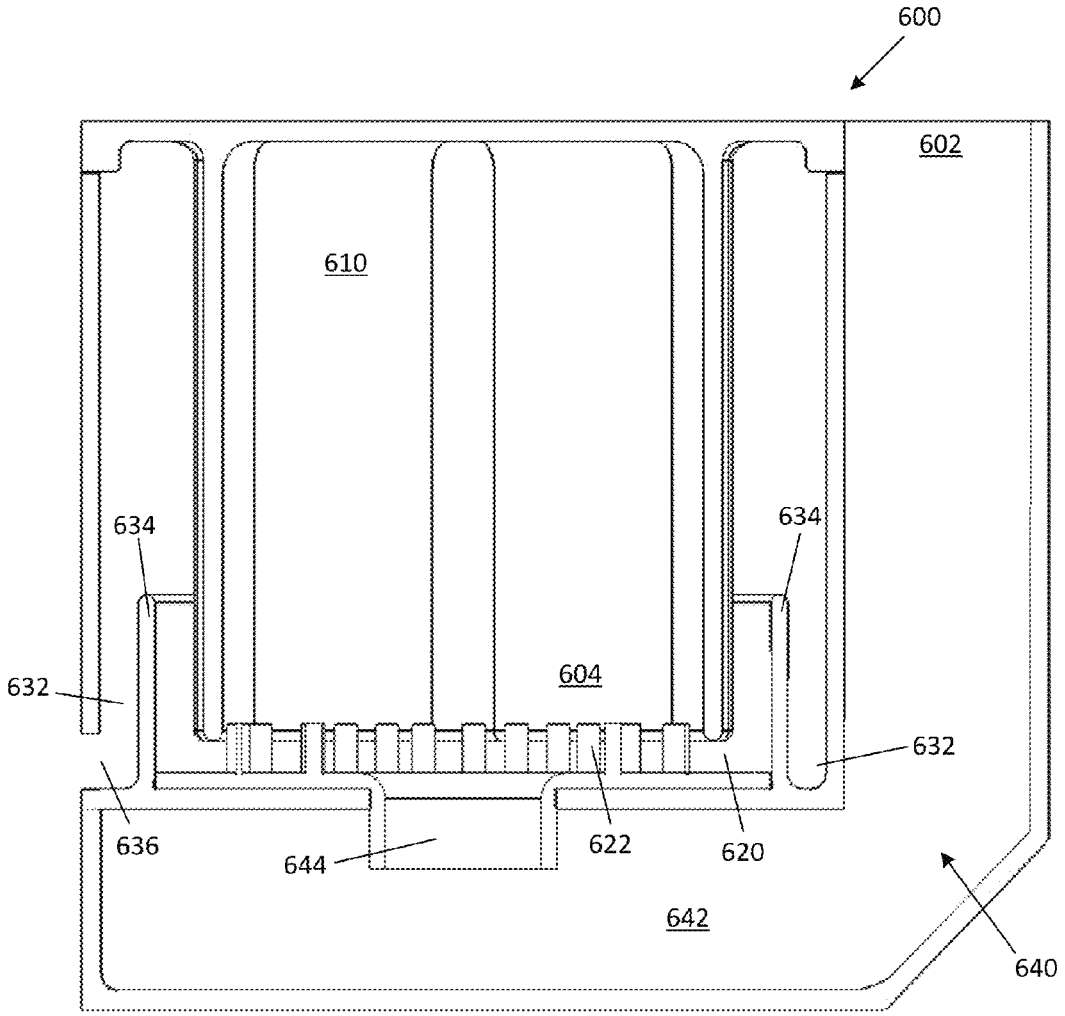
FIG. 6 is a cross-sectional view of a product dispenser similar to that shown in FIG. 5C.

Embodiments similar to those shown in FIGS. 5A-5C can be modified to operate substantially in reverse. FIG. 6 is a cross-sectional view of a product dispenser similar to that shown in FIG. 5C. FIG. 6 shows a dispenser 600 comprising a product guide 610 surrounded by a wall 634, which can be similar to that described with respect to FIG. 5C. Dispenser 600 can include an inlet portion 602 for receiving fluid. In some embodiments, dispenser 600 can include a fluid diverter 640 configured to direct the flow of fluid in accordance with the design of the dispenser 600. In the illustrated embodiment, fluid from the inlet portion 602 is guided by the fluid diverter 640 into a fill chamber 642. During operation, fluid can accumulate in the fill chamber 642 until it reaches aperture 644 in the reaction portion 604.

Once fluid fills the fill chamber 642 to the aperture 644, fluid can begin to enter the reaction chamber 604 via aperture 642. While not shown in FIG. 6, reaction chamber 604 can be configured to hold a generic or, in some embodiments, particular, solid product. Similar to previously described embodiments, product can be supported by a series of pegs 622 that allows the fluid to flow therethrough and under the product in order to dissolve the product and create a solution. In the illustrative embodiment of FIG. 6, fluid from the fill chamber 642 can flow between pegs and dissolve the product and form a solution in the reaction portion 604. In some embodiments, as fluid continues to enter the reaction portion 604, a formed solution flows through a gap 620 under the product guide 610 and the level of the solution rises until it reaches the height of wall 634.

When the solution reaches the height of the wall 634, it can flow over the wall into an annular output channel 632 similar to the annular channel 532 in FIG. 5C. In some embodiments, the annular output channel 632 is configured to direct all solution therein to the output drain 636. In some embodiments, output drain 636 is located in a side of the dispenser 600 opposite the inlet portion 602 and can be positioned to drain into, for example, a sink or bucket.

Figure 7A:
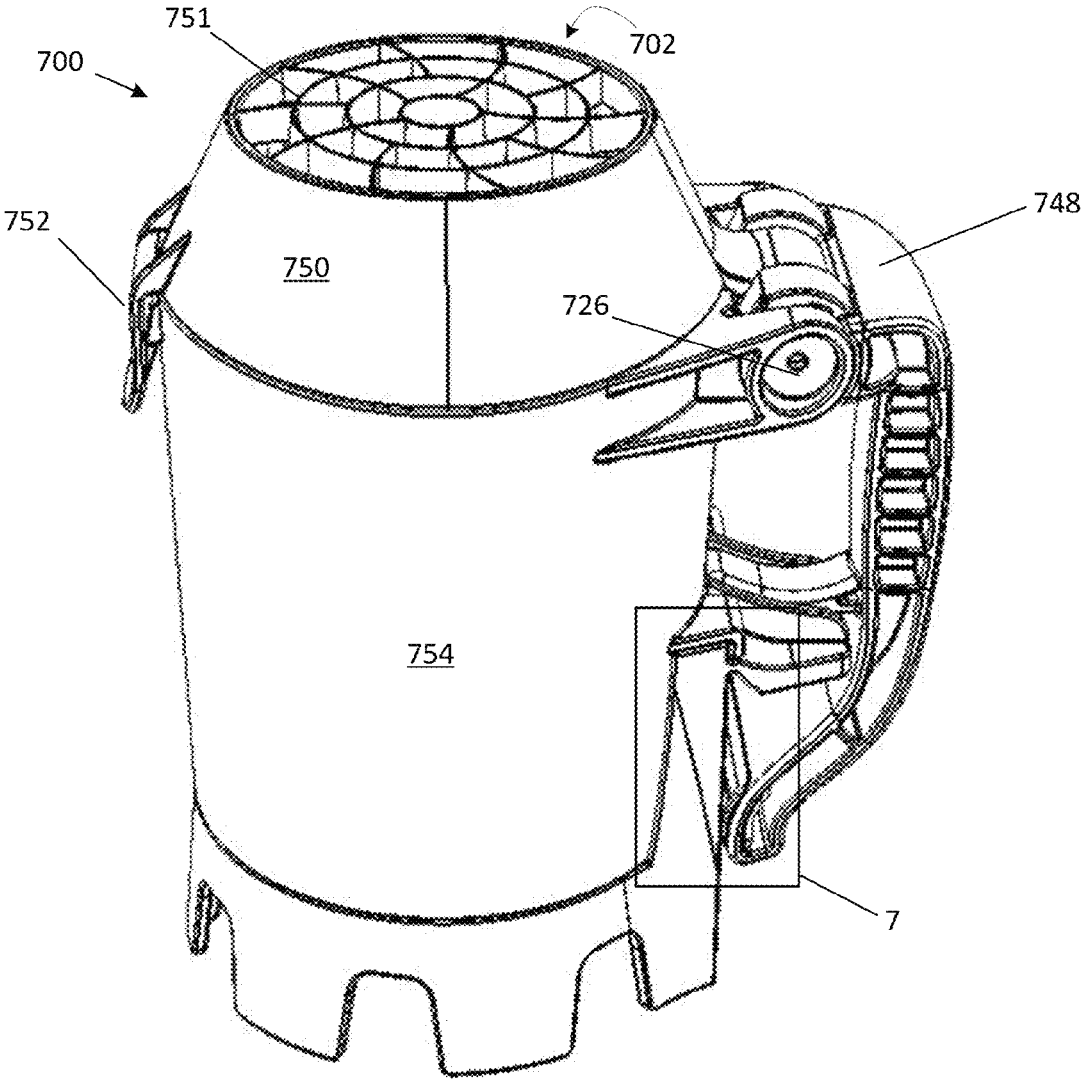
FIG. 7A is a perspective view of an embodiment of a product dispenser.

Another dispenser according to certain embodiments is illustrated in FIGS. 7A-7D. FIG. 7A is a perspective view of an embodiment of a product dispenser. The dispenser 700 shown in FIG. 7A comprises an outer wall 754 surrounding the interior of the dispenser 700 and an inlet portion 702 for receiving a fluid. The inlet portion 702 can include an annular cover 750 through which fluid can be directed. In some embodiments, annular cover 750 can be disposed over a fluid diverter which can direct incident fluid to the solid product. In some embodiments, such as described further below, the annular cover 750 can be arranged so as to require fluid directed into the opening of the annular cover 750 to contact a fluid diverter. As shown in FIG. 7A, the cover 750 can comprise a grate 751 through which incident fluid is directed. Grate 751 can prevent fluid from splashing out of the dispenser 700 undesirably while allowing incident fluid to be directed from outside the dispenser 700 through the annular cover 750. The cover 750 can be secured to the dispenser 700 via a hinge 726, which can allow for the cover 750 to be opened. Cover 750 can be secured closed via a latch 752 so that it does not open undesirably.

In some embodiments, the dispenser 700 includes a handle 748. The handle 748 can be used to support the dispenser 700 being held by a person or other mounting object. Handle 748 can be attached to dispenser 700 via hinge 726. In some embodiments, the annular cover 726 and handle 748 are attached to the dispenser 700 via different parts of the same hinge structure. For example, in some embodiments, handle 748 can be spring-loaded with respect to the dispenser 700, requiring a sufficient applied force (e.g., greater than 5-10 pounds, in some embodiments greater than 5-20 pounds) to rotate the bottom of the handle 748 away from the dispenser 700. In such an embodiment, the dispenser 700 can be secured to a surface by the spring-loaded handle. The annular cover 750 can be attached to the same structure as handle 748 without being spring-loaded. In some embodiments, cover 750 and handle 748 are attached to the dispenser 700 by separate attachment mechanisms.

Figure 7B:
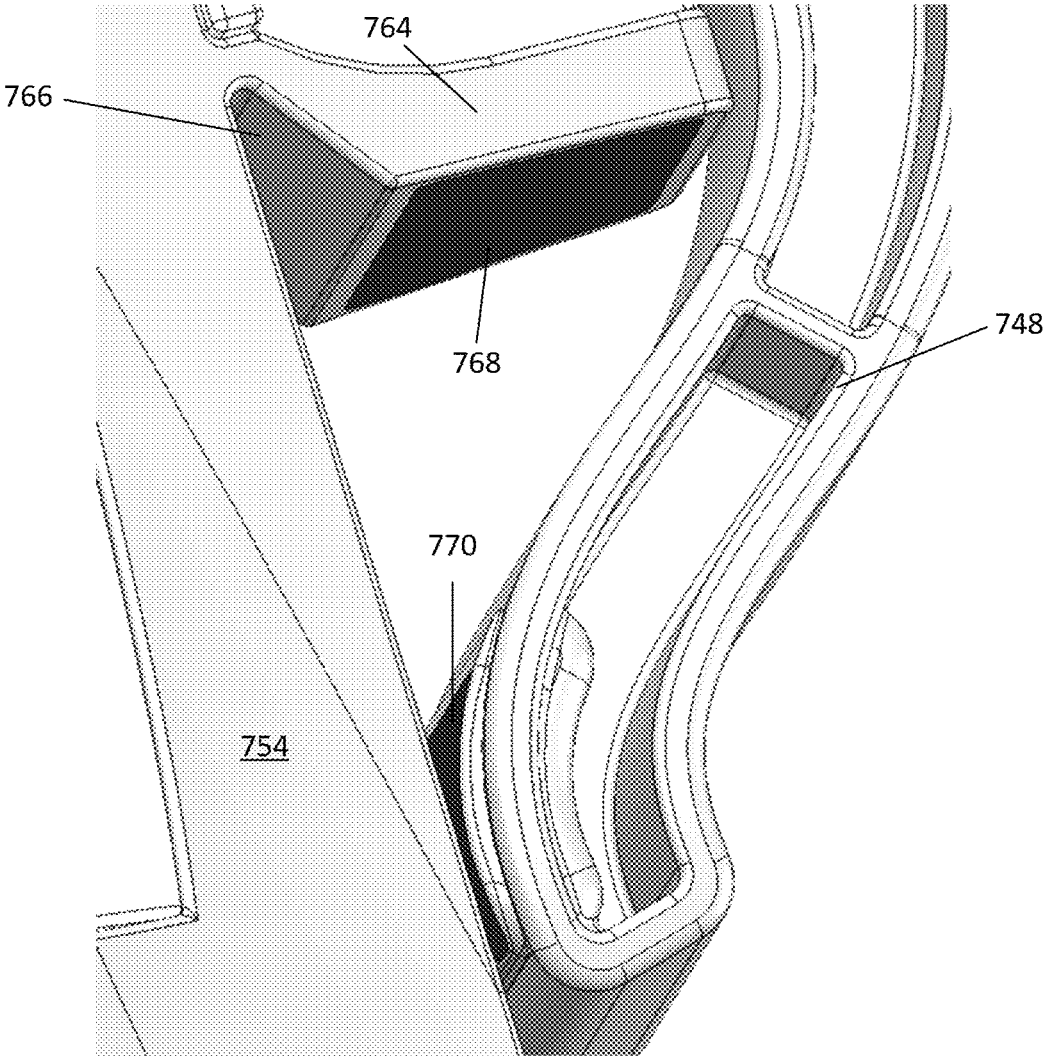
FIG. 7B is a view of the handle an embodiment of a dispenser, such as taken from box 7 in FIG. 7A.

FIG. 7B is a view of the handle an embodiment of a dispenser, such as taken from box 7 in FIG. 7A. In the embodiment of FIG. 7B, the dispenser 700 comprises a notch 766 proximate the handle 748 at the junction of the outer wall 754 of the dispenser and a tab 764 protruding therefrom. In some examples, notch 766 can receive a lip or edge of a supporting element for receiving and supporting the dispenser, such as an edge or partition of a sink or a bucket while handle engages the surface itself. In some embodiments, the notch 766 can be sized to stabilize the dispenser 700 on an edge smaller than 0.25 inches. In some situations, dispenser 700 can engage a supporting element having a top surface too large (in some embodiments, larger than 0.25 inches, for example) or otherwise not in a position to be received by the notch 766 when the handle engages the side of the supporting element. The tab 764 of the dispenser can comprise a first high friction surface 768 for engaging the top surface of a supporting element for supporting the dispenser 700. The first high friction surface 768 can act to increase the coefficient of friction between the tab 764 and a top surface of the supporting element so that when the handle 748 of the dispenser engages the supporting element, the first high friction surface 768 prevents the slipping of the dispenser 700 along the top surface of the supporting element.

In some embodiments, the dispenser handle 748 can include a second high friction surface 770 proximate the bottom of the handle 748. The second high friction surface 770 can be positioned so as to engage a side surface of a supporting element when the handle 748 is closed. In some embodiments, the spring force closing the handle squeezes the supporting element between the second high friction surface 770 of the handle 748 and the outer wall 754 of the dispenser 700 while at least one of the first high friction surface 768 and the notch engages a top surface of the supporting element. The second high friction surface 770 can be squeezed against the supporting element to prevent slipping of the dispenser 700 with respect to the supporting element.

First 768 and second 770 high friction surfaces can comprise any appropriate material to provide appropriate friction between the handle 748 and a supporting element for the dispenser 700. In some embodiments, high friction surfaces 768, 770 can comprise common elastomers such as silicone. The material can be chosen based on a common working environment of the dispenser 700. For example, materials can be selected to increase friction/improve stability when surfaces are wet, greasy and/or soapy. In some embodiments, first 768 and second 770 high friction surfaces can have a durometer between 50 and 60 Shore A. The position of first 768 and second 770 high friction surfaces can be optimized to provide stability on various supporting elements, including sinks and buckets. The handle 748 can be configured so that the second high friction surface 770 engages a supporting element at a substantially different height than the lowest point at which the outer wall 754 engages the supporting element in order to provide additional stability for the dispenser 770

Figure 7C:
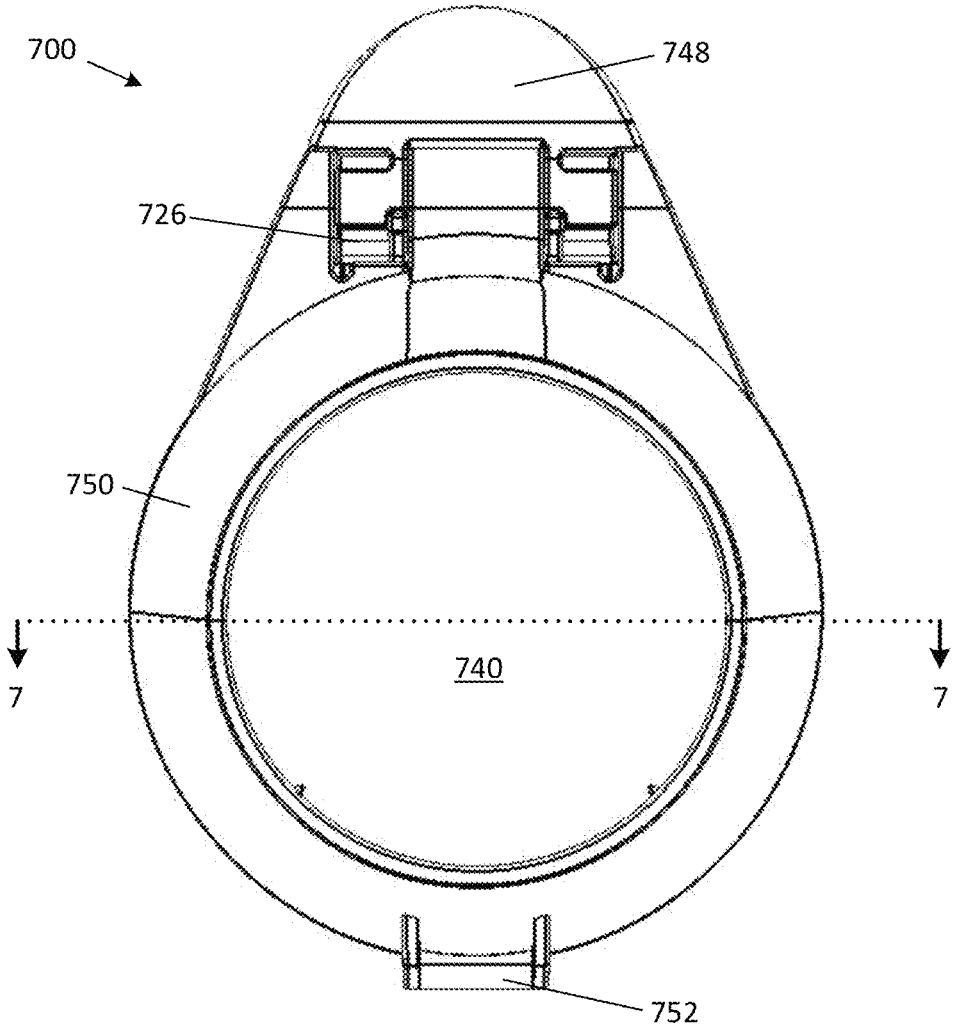
FIG. 7C is a top view of a dispenser such as that shown in FIG. 7A.

FIG. 7C is a top view of a dispenser such as that shown in FIG. 7A. The dispenser includes a fluid diverter 740 and an annular cover 750 disposed over the fluid diverter 740. As shown, in some embodiments, the interior dimension (e.g., diameter at the top of the cover) of the annular cover 750 is smaller than the diameter of the fluid diverter 740. The annular cover 750 can be attached to the dispenser 700 by a hinge 726 and secured closed by a latch 752. The dispenser 700 of FIG. 7C further includes a handle 748 attached via hinge 726 and in some embodiments can be spring-loaded to facilitate engagement of the dispenser 700 with a support surface.

Figure 7D:
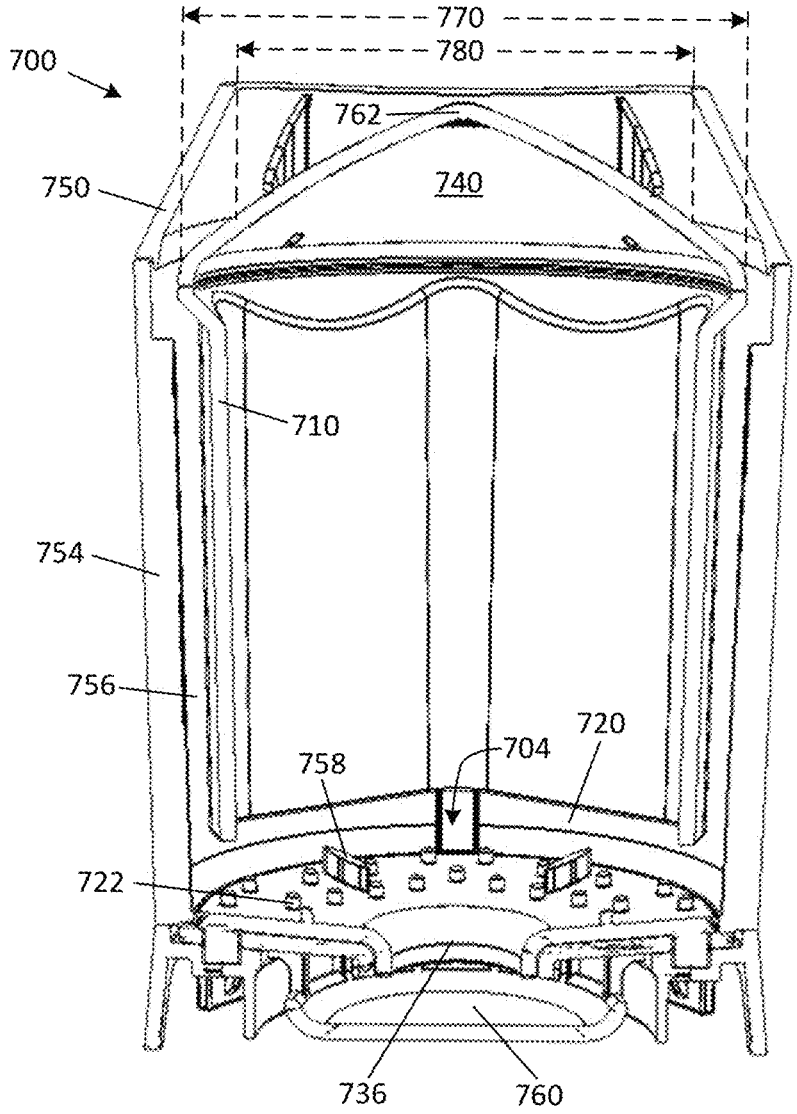
FIG. 7D is a cross-sectional view of the embodiment of FIG. 7C, taken at line 7-7.

FIG. 7D is a cross-sectional view of the embodiment of FIG. 7C, taken at line 7-7. The dispenser 700 in FIG. 7D includes a product guide 710 comprising a wall configured to receive a solid product. In some embodiments, the product guide can surround a height of the solid product. While present during operation of the dispenser, solid product is not shown in order to better illustrate additional components of the dispenser 700. The dispenser 700 can include pegs 722 configured to support the solid product off the base surface of the dispenser and allow a fluid to flow beneath and contact the solid product. The dispenser can include an outer wall 754 having an interior surface. The interior surface of the outer wall 754 can define a vertical channel 756 between the interior surface of the outer wall 754 and the product guide 710. In some embodiments, the vertical channel 756 extends around substantially the entire outer surface of the wall of the product guide 710. It will be appreciated that structure such as support structure between the outer wall 754 and the product guide 710 can exist in the vertical channel 756. The dispenser 700 can include a gap 720 beneath the product guide 710 and above the base of the dispenser 700 to allow fluid to flow therethrough under the product guide 710.

The dispenser 700 can include a fluid diverter 740, configured to receive a fluid and divert the fluid to a portion of the solid product. In the embodiment shown, fluid diverter 740 is disposed above the product guide 710. In some embodiments, the fluid diverter 740 engages, envelops, or overlaps the product guide 710 so that fluid is unable to enter through the top of the product guide 710. The fluid diverter 740 can divert fluid to a vertical channel 756 outside of the product guide 710, towards the bottom of the solid product.

Fluid diverter 740 can direct fluid down the vertical channel 756 into the reaction portion 704 of the dispenser 700. The reaction portion can be configured to support the solid product and receive fluid such that the fluid contacts and dissolves a portion of the solid product, forming a solution. In the illustrated embodiment, fluid can travel through the vertical channel 756 and through the gap 720 under the product guide 710 to contact the solid product. The fluid and product can form a solution in the reaction portion 704, and exit the dispenser 700 through an output drain 736. In some embodiments, output drain 736 is located proximate the center of the reaction portion 704 such that fluid flows inward from the vertical channel, through the reaction portion to the output drain 736.

The fluid diverter 740 can be configured to encourage sheeting of the fluid along the outside surface of product guide 710. That is, the design of the fluid diverter 740 can cause the fluid to follow the contour of the product guide 710 while flowing within vertical channel 756 on the outside of the product guide 710. Alternatively, the fluid diverter can cause the fluid to follow the contour of the interior of the outer wall 754 of the dispenser 700. In some embodiments, the fluid diverter 740 comprises an apex 762 substantially centered over the product guide 710 and a single surface extending radially outward from the apex and downward toward the top of the product guide 710. The single surface can be a smooth surface such that there are no corners or ridges extending from the apex 762 toward the product guide 710.

The design of the fluid diverter 740 can be such that when fluid impacts the diverter 740 proximate the apex 762, the fluid is spread around substantially the entire circumference of the diverter 740 prior to reaching the radially outermost portion of diverter 740. In this way, fluid can travel downward through the vertical channel 756 and contact the solid product from all sides. Dissolving the product evenly from all sides can result in a consistent erosion rate and solution concentration over time. In some embodiments, the dispenser 700 comprises an annular cover 750 disposed over the fluid diverter 740 and having an inner diameter 780. If inner diameter 780 (e.g., top of annular cover 750 in the embodiment shown in FIG. 7D) of the annular cover 750 is smaller than the diameter 770 of the fluid diverter 740 and is substantially centered over the diverter 740, the annular cover 750 can act to prevent fluid from entering the dispenser 700 without first contacting the fluid diverter 740. The annular cover 750 can, for example, cover the vertical channel 756 to prevent fluid from entering the channel 756 directly on only one side. The relationship of inner diameter 780 of the cover 750 and diameter 770 of the diverter 740 can be arranged so that fluid incident on the diverter 740 is directed to the entire circumference of the diverter 740, and consequently contacts the solid product from all sides.

During operation, as fluid flows past and dissolves portions of the solid product, wear patterns can be established in the solid product. Such patterns can change the surface area of the solid product contacted by the fluid, and can therefore have an (often mitigating) effect on the concentration of the produced solution. In some embodiments, the dispenser 700 can include platforms 758 disposed among the pegs 722 beneath the product guide 710. In such embodiments, top surface of the platforms 758 can be higher than top surface of the pegs 722 and configured to receive and support the solid product for an amount of use prior to the product contacting the pegs 722. In some embodiments, platforms are configured such that the net surface area of the platforms is significantly less than the net surface area of the pegs.

As fluid travels through pegs 722, defined flow paths through pegs 722 emerge and create wear patterns in the solid product. In some cases, as wear patterns emerge, dissolution of the solid product can become lessened, and the resulting concentration of the solution can decrease. Through use, however, the surface of the solid product being dissolved can become soft. With the weight of the solid product supported by a relatively small number of platforms 758, the weight is spread over a relatively small area. Accordingly, as the surface of the solid product becomes softer, platforms 758 may pierce the surface of the solid product, allowing the product to sink until it contacts pegs 722. Because, in some embodiments, the pegs 722 constitute a larger net surface area than platforms 758, the product can stop sinking and come to rest on the pegs 722. Lowering the product effectively increases the amount of product exposed to the fluid, and can act to increase the concentration. Accordingly, pegs 722 and platforms 758 can be optimized so that the concentration increase resulting from the sinking of the product can counteract the concentration decrease from the established wear patterns in the solid product. Platforms 758 shown in FIG. 7D are "canoe shaped," however it will be appreciated that various shapes (e.g., elliptical, oval, uniform cross-sectioned, downwardly increasing cross-sectioned such as frusto-conical, etc.) are possible while maintaining appropriate spacing and net surface area to support the product and allow the product to appropriately sink down when soft.

The dispenser 700 of FIG. 7D further comprises a drip catch 760 disposed beneath the output drain 736. Drip catch 760 is configured as a small reservoir to that holds a small volume of solution to prevent excess solution from undesirably dripping from the reaction portion 704 after use of the dispenser 700. In some embodiments, during operation, solution encounters drip catch 760 upon exiting the reaction portion 704. However, drip catch 760 can be designed to retain a small enough amount of solution so as not to significantly affect the throughput of the dispenser 700, while still capturing residual solution and/or input fluid from the reaction portion 104 after use. This can prevent unwanted leaking and dripping of solution and/or fluid when the dispenser 700 is not in use. Drip catch 760 only retains a limited volume. When the volume of solution held by drip catch 760 exceeds this limited volume, the solution spills out over the outer periphery or circumference (if circular) of drip catch 760 and drops downward out of the dispenser 700 in a manner similar to solution exiting the output drain 736 when the drip catch 760 is not present.

Figure 8:
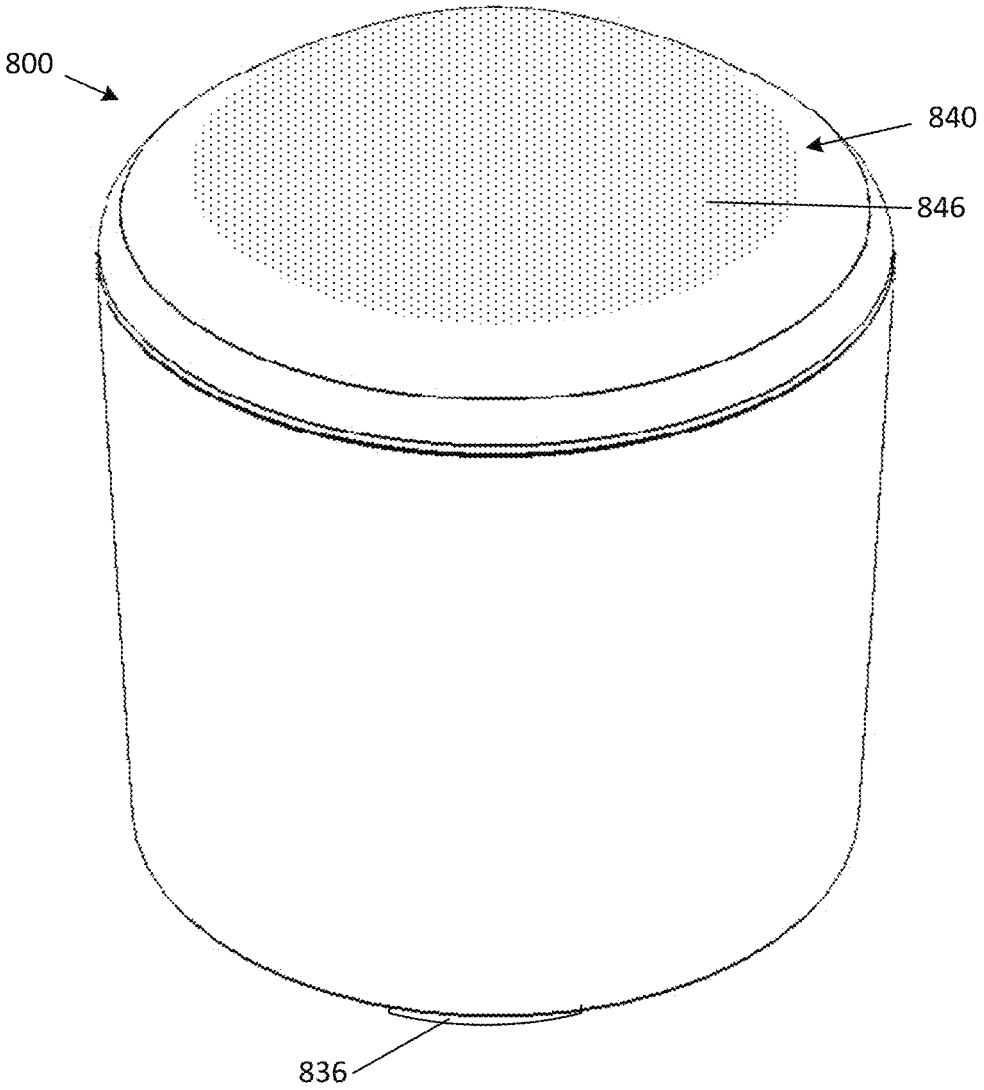
FIG. 8 is a perspective view of a dispenser in which fluid is applied to the top surface of a solid product.

While many embodiments include directing an input fluid to contact the bottom surface of a solid product, some embodiments include the ability to direct fluid to the top surface of a solid product. FIG. 8 is a perspective view of a dispenser in which fluid is applied to the top surface of a solid product. FIG. 8 shows a dispenser 800 comprising a fluid diverter 840. Fluid diverter 840 comprises a series of apertures 846 configured to allow fluid applied to the top surface of the fluid diverter 840 to pass through. In some examples, apertures 846 in the diverter 840 can comprise a screen.

During operation, fluid can travel through the apertures 846 and encounter the solid product beneath the diverter 840 in a reaction portion. The fluid can dissolve the solid product and create a solution, which can exit the dispenser 800 via an output drain 836. Output drain 836 can be located on the bottom side of the dispenser 800, as shown in FIG. 8, or can be disposed in a sidewall of the dispenser 800 such as the output drain shown in FIG. 6. The shape of the diverter 840 and apertures 846 can be varied among various embodiments to achieve a desired output solution concentration. In the embodiment of FIG. 8, the fluid diverter 840 comprises a domed screen. Apertures 846 can comprise circles, ovals, or any other shape, and can be arranged in any of a variety of configurations.

Various embodiments of the invention have been described. In a common configuration, an embodiment of the invention may be used in conjunction with a three-compartment sink; wherein different solutions are desired in each compartment for a multi-step procedure, for example washing dishes. In such a configuration, a first embodiment of the invention may be configured to dispense a solution comprising a first solid product into a first compartment of the sink, while a second embodiment of the invention may be configured to dispense a solution comprising a second solid product into a second compartment of the sink. Thus, using the sink, a user may apply a fluid, such as water conveniently supplied by the sink, to each of the embodiments of the invention, thereby dispensing the desired first and second solutions in separate compartments of the sink. For example, in a three compartment sink, embodiments of the invention could be used to produce a detergent solution in the first compartment of the sink and a sanitizer solution in the third compartment while leaving only water in the second compartment, organizing the sink contents in order of use. Additional embodiments of the invention comprising additional solid products may be used in processes requiring additional solutions.

Embodiments of the invention may also comprise a mounting member for attaching the dispenser to or near a container for receiving the dispensed solution. For example, the dispenser may be attachable to the edge of a sink via the mounting member so that as a solution flows out of the outlet portion, it flows directly into the sink. It may additionally be attached such that the faucet of the sink conveniently directs fluid into the inlet portion of the invention. The dispenser may also be mounted on an alternative container such as a mop bucket, for example. In this exemplary configuration, the dispenser may be mounted on the mop bucket and arranged so that a created solution such as a floor cleaning solution flows directly into the bucket. Other embodiments of the invention may enable the mounting of the dispenser to a wall in a location that may be proximate a fluid source. In such a configuration, the fluid source may supply fluid to the inlet portion of the dispenser, and the solution may flow out of the outlet portion into any number of desired locations, such as a sink compartment or a bucket. Exemplary mounting members can include, for example, the spring-loaded handle shown in the embodiment of FIG. 7A.

Furthermore, embodiments of the invention configured for holding various solid products (comprising differently shaped product guides, for example) may have similar or like mounting members, allowing for these embodiments to be interchangeably mounted on a container, wall, or other mounting location appreciated by those skilled in the art. Embodiments described herein can be mounted and used in a variety of configurations and locations, including fixed and portable locations. The designs of the dispensers described are such that they can operate in atmospheric conditions. That is, they do not require a pressurized fluid source in order to create solutions. Accordingly, free-standing dispensers can be added and removed from fluid sources quickly and easily.

It has been previously noted that various factors may contribute to the concentration of the solution dispensed from the invention. Oftentimes there may be a certain range that the concentration is desired to fall within. Accordingly, elements of the invention may be adjusted in a factory or laboratory setting in order to achieve a concentration within the desired range for a particular operating condition. Moreover, elements may be optimized in order to achieve a concentration within a desired range for any in a range of typical operating conditions, for example a temperature range of 90-140 degrees Fahrenheit with a flow rate in the range of four to eight gallons-per-minute. Among others, elements that may be optimized include peg size, shape, and number density, along with the shape and depth of the hull. Those skilled in the art will appreciate that modification and optimization of additional components of the invention may also accomplish desired changes in the concentration.

In addition to achieving a desired concentration, it can be important to maintain concentrations within a desired range through the course of several operations. In addition to parameters such as temperature and flow rate, concentration can also be affected by the surface area of solid product exposed to the incident fluid and energy of the incident fluid. Accordingly, some embodiments are configured to achieve a substantially planar dissolution pattern so that the surface area of the product exposed to the fluid remains substantially constant. In addition, some embodiments are configured to provide the input fluid with sufficient incident energy to achieve desirably high concentrations. Energy can be provided, for example, by allowing the fluid to be accelerated a distance by gravity so that it impacts the solid product with a high velocity. The height from which a fluid is accelerated can therefore be used to adjust the output solution concentration.

As shown in the illustrated embodiments and described above, the product guide may be shaped such that it receives a particularly shaped solid product. Often, this solid product is of the same shape as the product guide, as shown in the pentagonal configuration of FIG. 1A, and further prohibits differently shaped products, such as a hexagonal product, from entering the product guide. Different embodiments of the invention may further be configured to hold stacks of multiple solid product blocks, wherein two pentagonal shaped product blocks may be stacked on one another in the product guide, for example. Maintaining a stack of at least two product blocks in the product guide may be advantageous, since if the first dissolves completely, there remains product available to dissolve and form the solution. Otherwise fluid may enter the dispenser, encounter no product block, and continue out of dispenser substantially unchanged.

Various embodiments of the invention have been described. It should be known that the embodiments described herein are exemplary in nature and in no way limit the scope of the invention. Rather, they serve as examples illustrating various features and embodiments thereof. These and other embodiments are within the scope of the following claims.

The invention claimed is:

1. A freestanding product dispenser for dispensing a solution of a fluid and a solid product comprising:

a product guide having a wall and surrounding a height of the solid product;

a fluid diverter for receiving and diverting an input fluid toward at least a portion of the solid product;

a reaction portion having pegs and platforms configured to support the solid product, wherein the platforms have a top surface higher than a top surface of the pegs and a net surface area of the platforms is less than a net surface area of the pegs, the reaction portion configured to receive fluid from the fluid diverter such that the fluid contacts and dissolves a portion of the solid product, forming the solution; and an output drain for dispensing the solution.

2. The dispenser of claim 1, wherein the fluid diverter is disposed above the solid product and coupled to the product guide, and is configured to divert the input fluid around the exterior of the product guide toward the base of the solid product; and the reaction portion receives the fluid from the fluid diverter such that the fluid contacts and dissolves the base of the solid product.

3. The dispenser of claim 2, wherein the fluid diverter is configured to cause the fluid to follow the contour of the product guide toward the reaction portion.

4. The dispenser of claim 2, wherein the fluid diverter directs fluid to the reaction portion such that the fluid contacts the solid product from all sides.

5. The dispenser of claim 2, wherein the fluid diverter comprises an apex substantially centered above the product guide, and a single surface extending radially from the apex toward the top of the product guide.

6. The dispenser of claim 5, wherein the fluid diverter engages the top of the product guide such that the engagement prevents fluid from entering the top of the product guide.

7. The dispenser of claim 2, further comprising an outer wall having an interior surface defining a vertical channel between the interior surface of the outer wall and the wall of the product guide.

8. The dispenser of claim 7, wherein the vertical channel extends around substantially the entire outer surface of the wall of the product guide.

9. The dispenser of claim 7, further comprising an annular cover disposed at least over the vertical channel and covering the vertical channel so as to not allow incident fluid to flow directly into the vertical channel without first impinging on the fluid diverter.

10. The dispenser of claim 9, wherein the annular cover comprises a grate disposed over the fluid diverter.

11. The dispenser of claim 7, wherein the output drain is centered beneath the product guide such that fluid flows inward from the vertical channel, through the reaction portion, and exits through the output drain.

12. The dispenser of claim 11, further comprising a drip catch disposed below the output drain.

13. The dispenser of claim 1, wherein the pegs are arranged such that the fluid flows through the spaces between the pegs as it travels through the dispenser to the output drain, and wherein the pegs and platforms are configured such that when a solid product is lowered into the reaction portion from above, the platforms receive the solid product prior to the pegs.

14. The dispenser of claim 13, wherein the platforms are configured such that, as the solid product is used, the platforms pierce the bottom surface of the solid product so that the solid product lowers onto the pegs.

15. The dispenser of claim 1, wherein fluid flows through the dispenser at atmospheric pressure.

16. The dispenser of claim 1, wherein the fluid diverter comprises a domed screen disposed above the solid product, and is configured to direct fluid through apertures in the screen to the top surface of the solid product.

17. The dispenser of claim 1, wherein the fluid diverter comprises a fill chamber disposed beneath the reaction portion supporting the solid product such that when the fill chamber is filled with fluid, fluid is directed into the reaction portion from the fill chamber.

18. The dispenser of claim 17, wherein the reaction portion comprises a wall such that (i) fluid enters the reaction portion from the fill chamber and encounters the solid product, forming the solution; and (ii) the solution accumulates in the reaction portion until it flows over the top of the reaction portion wall and to the output drain.

19. The dispenser of claim 18, wherein the solution flows over the top of the wall into an annular output channel prior to reaching the output drain.

20. The dispenser of claim 17, wherein the reaction portion comprises a center aperture through which fluid flows from the fill chamber to the reaction portion.

21. The dispenser of claim 1, further comprising a spring-loaded handle configured to engage a surface of a supporting element to support the dispenser.

22. The dispenser of claim 21, further comprising an outer wall and a tab protruding from the outer wall toward the handle, the tab and outer wall defining a notch located at the junction of the tab and the outer wall for receiving a lip or ridge of the supporting element to support the dispenser.

23. The dispenser of claim 22, further comprising at least one friction surface disposed on at least one of the tab and the spring-loaded handle for engaging the supporting element to support the dispenser, the at least one friction surface having a coefficient of friction greater than a coefficient of friction of the supporting element to support the dispenser.

24. The dispenser of claim 1, wherein the product guide is shaped so as to receive a specific solid product.

25. A freestanding product dispenser for dispensing a solution of a fluid and a solid product comprising:

a product guide having a wall surrounding the solid product, the wall of the product guide defining a length from a first end to a second end and a perimeter, the length and perimeter forming a solid surface;

a fluid diverter for receiving and diverting an input fluid around the outside and toward the base of the solid product, wherein the fluid diverter has an inlet portion disposed above the solid product and coupled to the product guide;

an outer wall having an interior surface defining a vertical channel between the interior surface of the outer wall and the wall of the product guide, wherein the vertical channel extends around substantially the entire outer surface of the wall of the product guide, and wherein the vertical channel is in fluid communication with the fluid diverter;

a reaction portion housing the solid product, wherein the vertical channel is in fluid communication with the reaction portion, wherein the reaction portion is configured to receive fluid from the vertical channel such that the fluid contacts and dissolves the base of the solid product, forming the solution; and an output drain for dispensing the solution.

26. The dispenser of claim 25, wherein the product guide is shaped to receive a particular solid product for use with the dispenser.

* * * * *